US007797914B2

(12) United States Patent
Marcinik et al.

(10) Patent No.: US 7,797,914 B2
(45) Date of Patent: Sep. 21, 2010

(54) METHOD AND DEVICE FOR HOLDING ENVELOPES DURING INSERTION

(75) Inventors: Robert F. Marcinik, Wallkill, NY (US); Richard A. Suleski, Southington, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 11/967,493

(22) Filed: Dec. 31, 2007

(65) Prior Publication Data

US 2009/0165426 A1 Jul. 2, 2009

(51) Int. Cl.
*B65B 43/26* (2006.01)

(52) U.S. Cl. ..... 53/569; 53/206; 53/284.3; 493/216

(58) Field of Classification Search ..... 53/569, 53/206, 284.3, 381.5, 473, 474; 493/186, 493/216, 917

See application file for complete search history.

(56) References Cited

U.S. PATENT DOCUMENTS 3,935,800 A * 2/1976 Sette et al. ..... 493/465
5,052,168 A * 10/1991 DeWitt et al. ..... 53/492
5,156,585 A * 10/1992 Dimur et al. ..... 493/409
5,247,780 A * 9/1993 Kulpa et al. ..... 53/381.5
5,388,388 A * 2/1995 Belec et al. ..... 53/460
5,457,941 A * 10/1995 Long et al. ..... 53/460
5,675,959 A * 10/1997 Hamma et al. ..... 53/381.1
5,715,648 A * 2/1998 Yates ..... 53/381.5
5,921,065 A * 7/1999 Slyster et al. ..... 53/473
5,992,132 A * 11/1999 Auerbach ..... 53/569
6,129,389 A * 10/2000 Younger ..... 283/116
6,293,076 B1 * 9/2001 Miller et al. ..... 53/460
6,453,651 B1 * 9/2002 Werner ..... 53/569
6,893,387 B1 * 5/2005 Dahlquist ..... 493/216
7,326,164 B2 * 2/2008 Abe et al. ..... 493/222
7,389,624 B2 * 6/2008 Henry et al. ..... 53/381.5
7,398,635 B2 * 7/2008 Fairweather et al. ..... 53/569
7,487,965 B2 * 2/2009 Stemmle ..... 271/220

* cited by examiner

*Primary Examiner*—Sameh H. Tawfik
(74) *Attorney, Agent, or Firm*—Michael J. Cummings; Angelo N. Chaclas

(57) ABSTRACT

An inserting system is provided for securing an envelope having a window. The system includes a deck slidably supporting the envelope, where the deck defines an insertion area, and a securing mechanism in the insertion area securing the envelope in an insertion location during insertion of a collation. The securing mechanism includes a first securing element selectively securing a first portion of the envelope between the window and an open edge of the envelope and a second securing element selectively securing a second portion of the envelope between the window and a closed edge of the envelope. The inserting system may also include a deflection element disposed on the deck between the first securing element and the second securing element, wherein the deflection element guides the collation away from an edge of the window.

10 Claims, 10 Drawing Sheets

METHOD AND DEVICE FOR HOLDING ENVELOPES DURING INSERTION

FIELD OF THE INVENTION

The present invention relates to a mail inserter and, more particularly, to an inserting system for securing an envelope having a window.

BACKGROUND OF THE INVENTION

Machines for inserting items, such as sheets of paper, for example, into envelopes are known in the art. A typical mail inserter is shown in FIG. 1. As shown in FIG. 1, the mail inserter 1 has an inserting station 5 wherein a collation or insert material is inserted into a receiving envelope. The mail inserter 1 comprises an envelope supply module 10 to supply the envelopes and a collation supply module 70 to supply the insert material. A typical insert material supply module has a plurality of feeders for separately releasing sheets of insert material onto a moving belt where the sheets of insert material are cumulated into stacks. The stacks of insert material are sequentially moved into the inserting station for insertion.

From the envelope supply module 10, envelopes are retrieved one at a time by an envelope retrieval mechanism 20 and the retrieved envelope is moved toward the envelope inserting station 5. Before reaching the inserting station 5, the flap of the retrieved envelope is opened by a flap opening mechanism 30. In the inserting station 5, the throat of the envelope is opened by a throat opening mechanism 40, so as to allow the insertion module 60 to move a collation (e.g., a pack of insert material) into the receiving envelope. After the insertion is completed, the stuffed envelope is moved away from the inserting station 5. A flap closing section 50 is used to close the flap of the stuffed envelope. The closed envelope is then sealed and further processed.

When envelopes having a window are processed for collation insertion, the edges of the window may present catch points as the collation is inserted. The catch points may cause a jam during the insertion process.

SUMMARY OF THE INVENTION

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

One aspect of the invention relates to an inserting system for securing an envelope having a window comprising a deck slidably supporting the envelope, the deck defining an insertion area, and a securing mechanism in the insertion area securing the envelope in an insertion location during insertion of a collation. The securing mechanism may comprise a first securing element selectively securing a first portion of the envelope between the window and an open edge of the envelope, and a second securing element selectively securing a second portion of the envelope between the window and a closed edge of the envelope.

In one embodiment, the inserter system further comprises a deflection element disposed on the deck between the first securing element and the second securing element, wherein the deflection element guides the collation away from an edge of the window.

In another aspect, the invention relates to an inserting system for securing an envelope having a window during insertion of a collation, the system comprising a deck slidably supporting the envelope, a first securing element selectively securing the envelope between the window and an open edge of the envelope, and a second securing element selectively securing the envelope between the window and a closed edge of the envelope.

In yet another aspect, the invention provides a method of securing an envelope having a window in an inserting system, the method comprising moving the envelope along a deck into an insertion area, securing the envelope between the window and an open edge of the envelope with a first securing element, securing the envelope between the window and a closed edge of the envelope with a second securing element, and guiding a collation away from an edge of the window with a deflection element.

In a further aspect, the invention relates to a method for use in an envelope inserting station. In one embodiment, the method comprises providing an air suction module in an insertion area in the envelope inserting station, wherein the insertion area has a deck for supporting an envelope, and wherein the envelope has a first panel having an open window, a flap connected to the first panel, and a second panel, the first and second panels defining an envelope throat, wherein the first panel is in physical contact with the deck when the envelope is located in the insertion area, with the flap opened to expose the envelope throat to allow insert material to move into the throat. The method may further comprise applying a negative air pressure through the air suction module on at least a section of the first panel adjacent to the open window at least when the insert material is moved into the throat.

In one embodiment, the air suction module comprises a plurality of apertures on the deck, such that when the envelope is located in the insertion area, at least some of the apertures are covered by said section of the first panel of the envelope.

In a further embodiment, the envelope has a first edge, and an opposing second edge where the flap is connected to the first panel, and the envelope inserting station has a guide for guiding the first edge of the envelope when the envelope is moved into the insertion area, and wherein the apertures are located adjacent to the guide.

In yet another aspect, the invention provides an apparatus for use in an envelope inserting station. The apparatus may comprise a housing having a surface with a plurality of apertures opened through the surface, wherein the envelope insertion station has a deck in an insertion area for supporting an envelope having an open window facing the deck, and an air conduit configured for connection to an air intake mechanism so as to allow the air intake mechanism to provide a negative air pressure through the apertures, such that when the envelope is located in the insertion area for collation insertion, part of the open window is held down to the deck by the negative air pressure.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The accompanying drawings, which are incorporated in and constitute a part of this specification, illustrate exemplary embodiments of the invention and, together with the description, serve to explain the principles of the invention. In the drawings.

DETAILED DESCRIPTION OF EXEMPLARY EMBODIMENTS

Reference will now be made in detail to exemplary embodiments of the invention, examples of which are illustrated in the accompanying drawings. Wherever possible, the same reference numbers will be used throughout the drawings to refer to the same or like parts.

An opening, e.g., a window, on the front of an envelope has edges that may present a catch point as a collation is inserted into the envelope in an insertion station. The present invention provides embodiments of a method and device for holding the envelope in order to prevent a collation from catching on an edge of the window when the collation is inserted.

Figure 1:
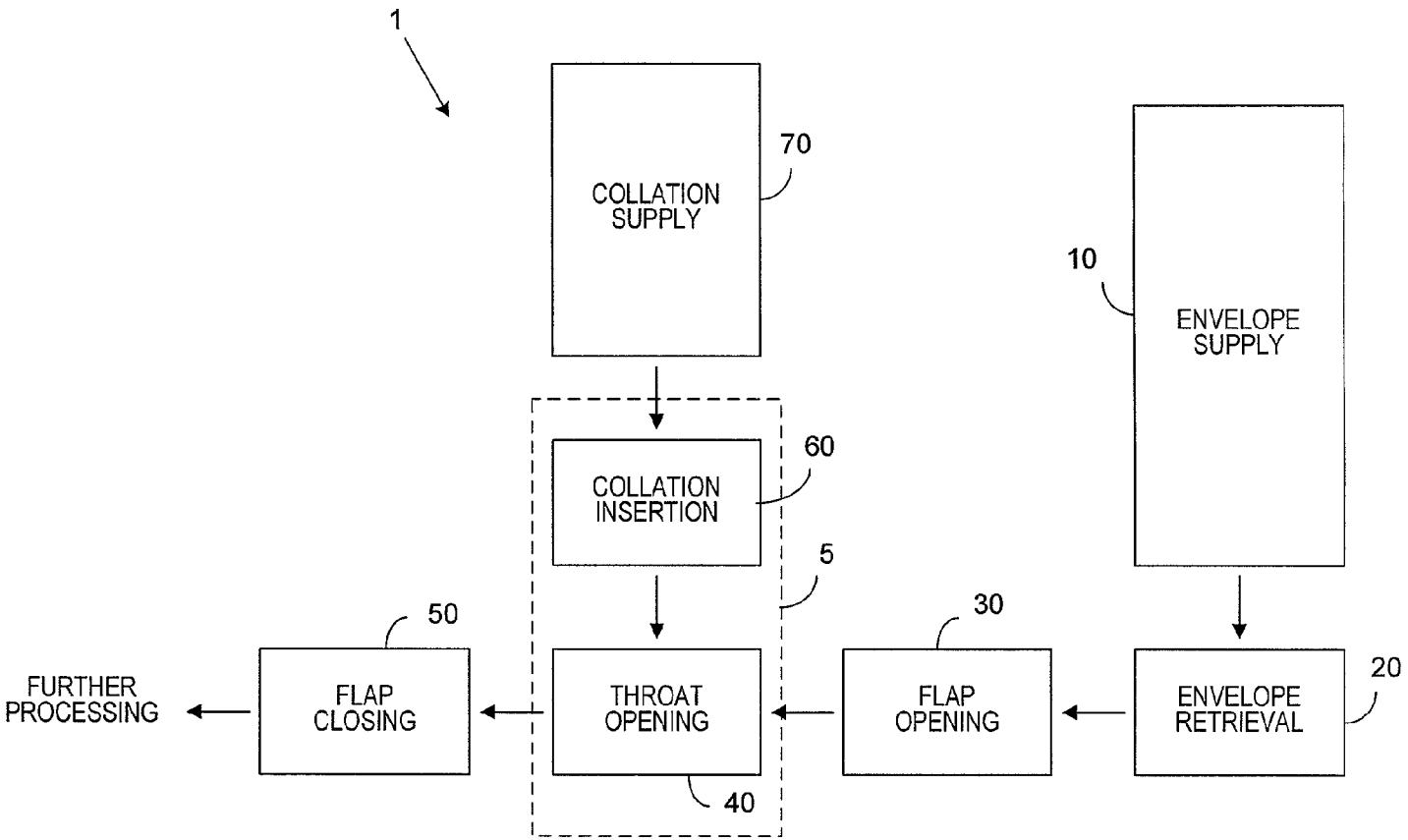
FIG. 1 (PRIOR ART)
FIG. 1 is a block diagram showing various functions in a conventional mail inserter.
Figure 2:
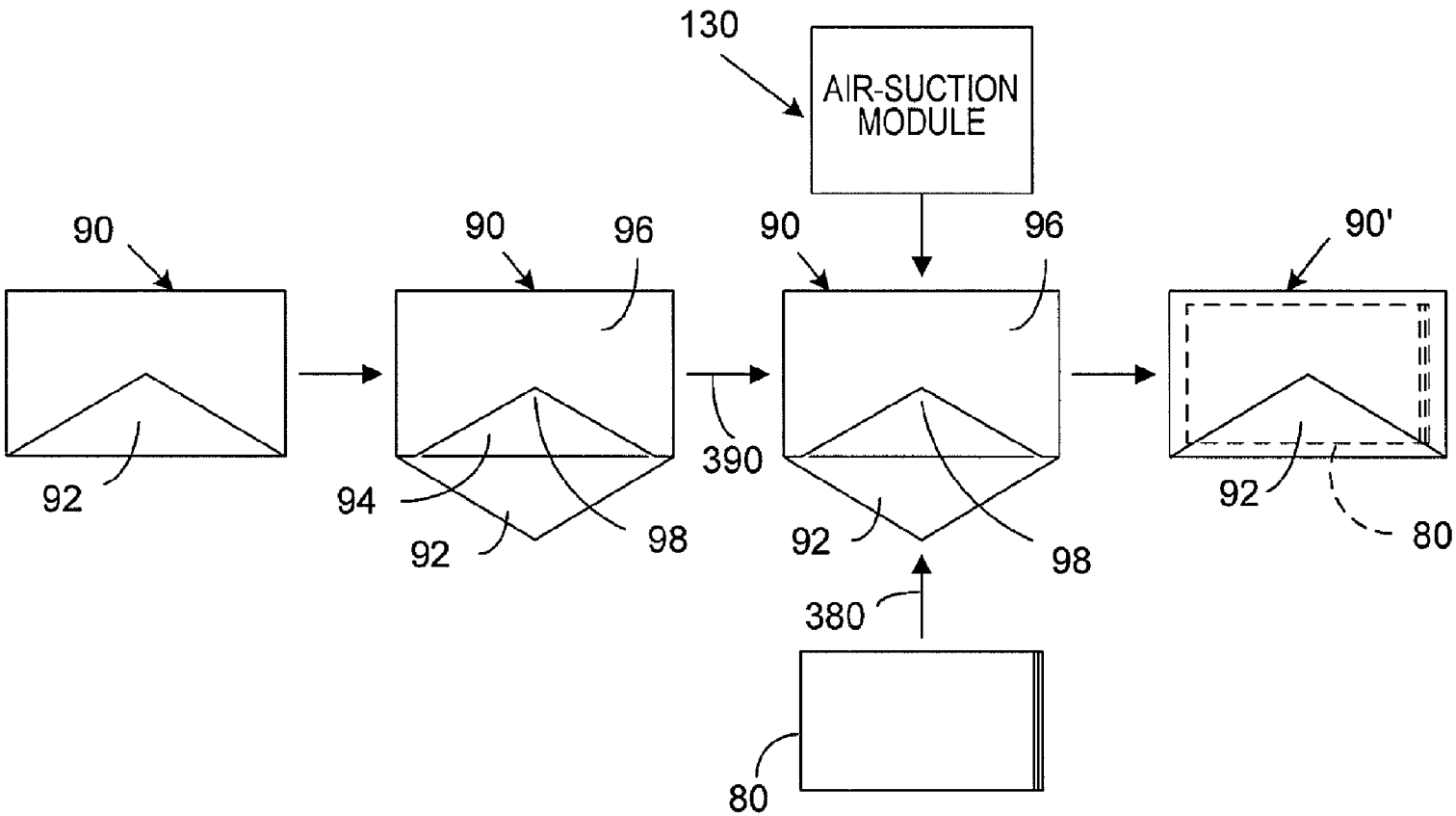
FIG. 2 is a schematic view of an envelope at various stages in a mail inserter according to an embodiment of the invention.

FIG. 2 shows an envelope at various stages in a mail inserter, according to embodiments of the present invention. As shown in FIG. 2, an envelope 90 has a flap 92. After the flap 92 is opened, a throat 98 is exposed. The throat 98 is formed by a front envelope panel 94 and a back envelope panel 96. After the flap 92 is opened, the envelope 90 is moved to the inserting station along a direction 390. In the inserting station, the throat 98 is opened to allow a collation 80 to move along direction 380 into the envelope 90. As collations are inserted into the envelope 90, the present invention provides an air suction module 130 to prevent the edges of the window from being a catch point.

Figure 3A:
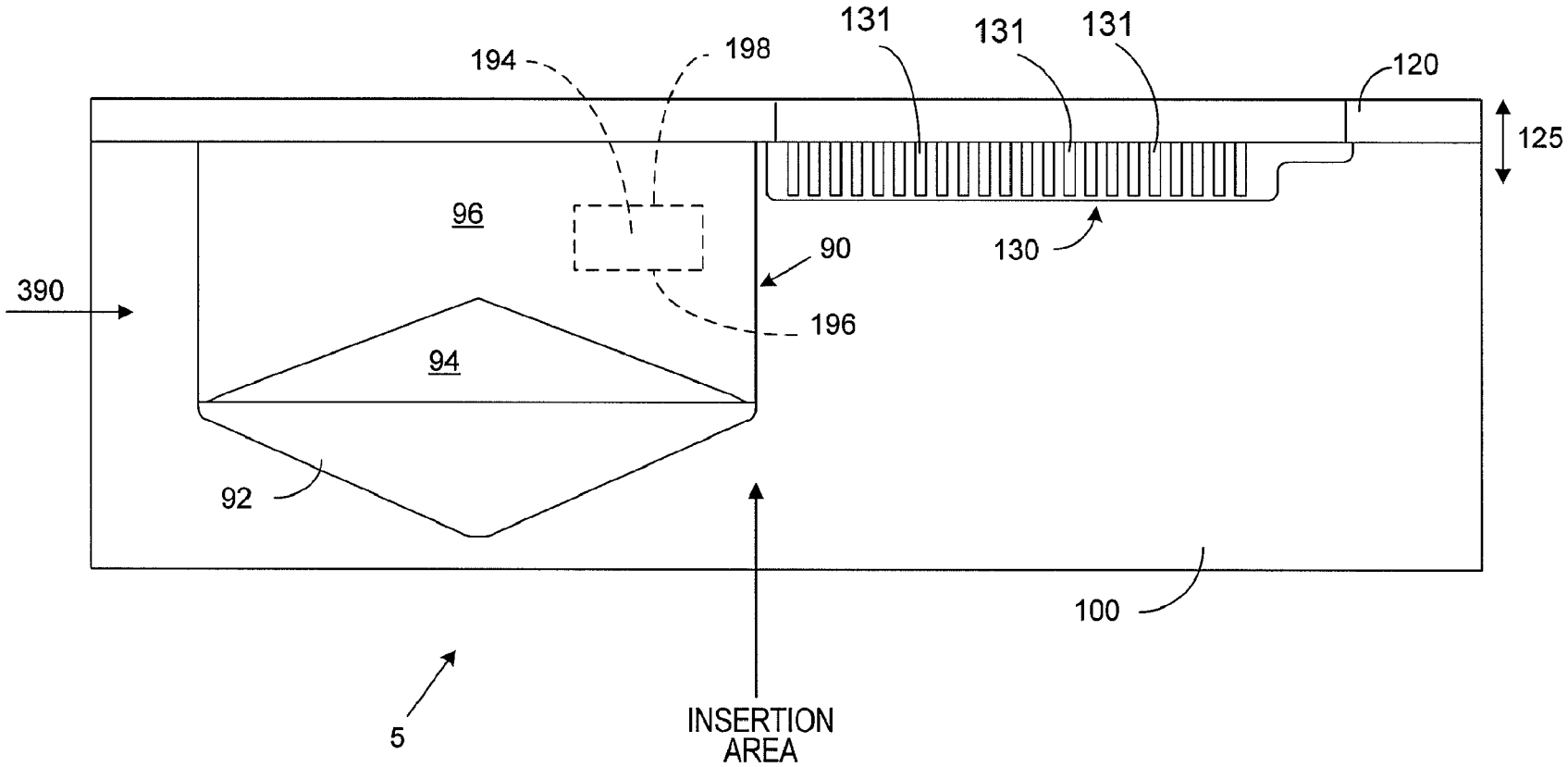
FIG. 3*a* is a top view of an envelope entering the inserting station for collation insertion according to an embodiment of the invention.
Figure 3B:
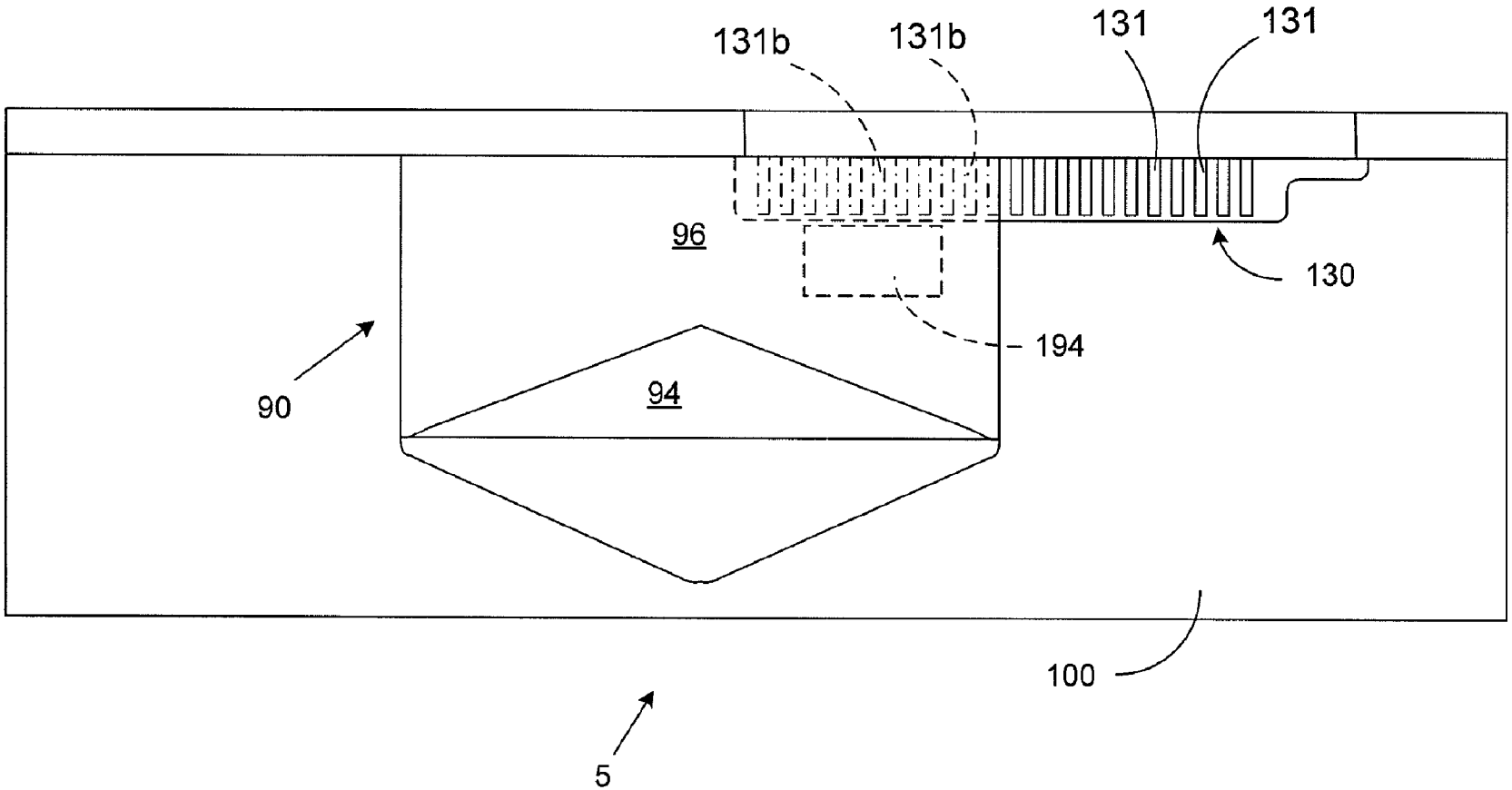
FIG. 3*b* is a top view of an envelope in an insertion area in the inserting station according to an embodiment of the invention.

FIGS. 3*a* and 3*b* are diagrammatic representations of an envelope inserting station showing an envelope with its throat opened to allow a collation to move into the envelope. As shown in FIGS. 3*a* and 3*b*, the envelope inserting station 5 has a deck 100 to slidably support an envelope 90 when the envelope is located in the insertion area. The deck 100 has a guide 120 for guiding one edge of the envelope when the envelope is moved into the insertion area. An air suction module 130 having a plurality of slots 131 is disposed on the deck 100 to provide an air intake. The slots 131 can be made as part of the guide 120, according to one embodiment of the present invention. The slots can also be part of the air suction module 130. The air suction module 130 can be fixedly attached to the guide 120, or can be separable from the guide 120, according to different embodiments of the present invention. Moreover, the guide 120 can be designed such that it is movable from the deck 100, or it can be adjusted along the direction 125 to accommodate different size envelopes.

The envelope 90 has a window 194 on the front envelope panel 94. The window 194 has a first edge 196 and an opposing edge 198 farther from the flap 92 as compared to the first edge 196. When the envelope 90 reaches the insertion area where a collation will be inserted into the throat of the envelope, a section of the envelope covers some of the slots 131 of the air suction module 130. As shown in FIG. 3*b*, the slots 131 are positioned such that the window 194 is slightly off the blocked slots 131*b*. When the collation is inserted, the section of the envelope that is over the slots 131*b* is held down on the deck by the negative air pressure provided by the air suction module 130. In that arrangement, the second edge 198 (see FIG. 3*a*) of the window 194 can be held down to the deck and the edge 198 is prevented from becoming a catch point.

Figure 4:
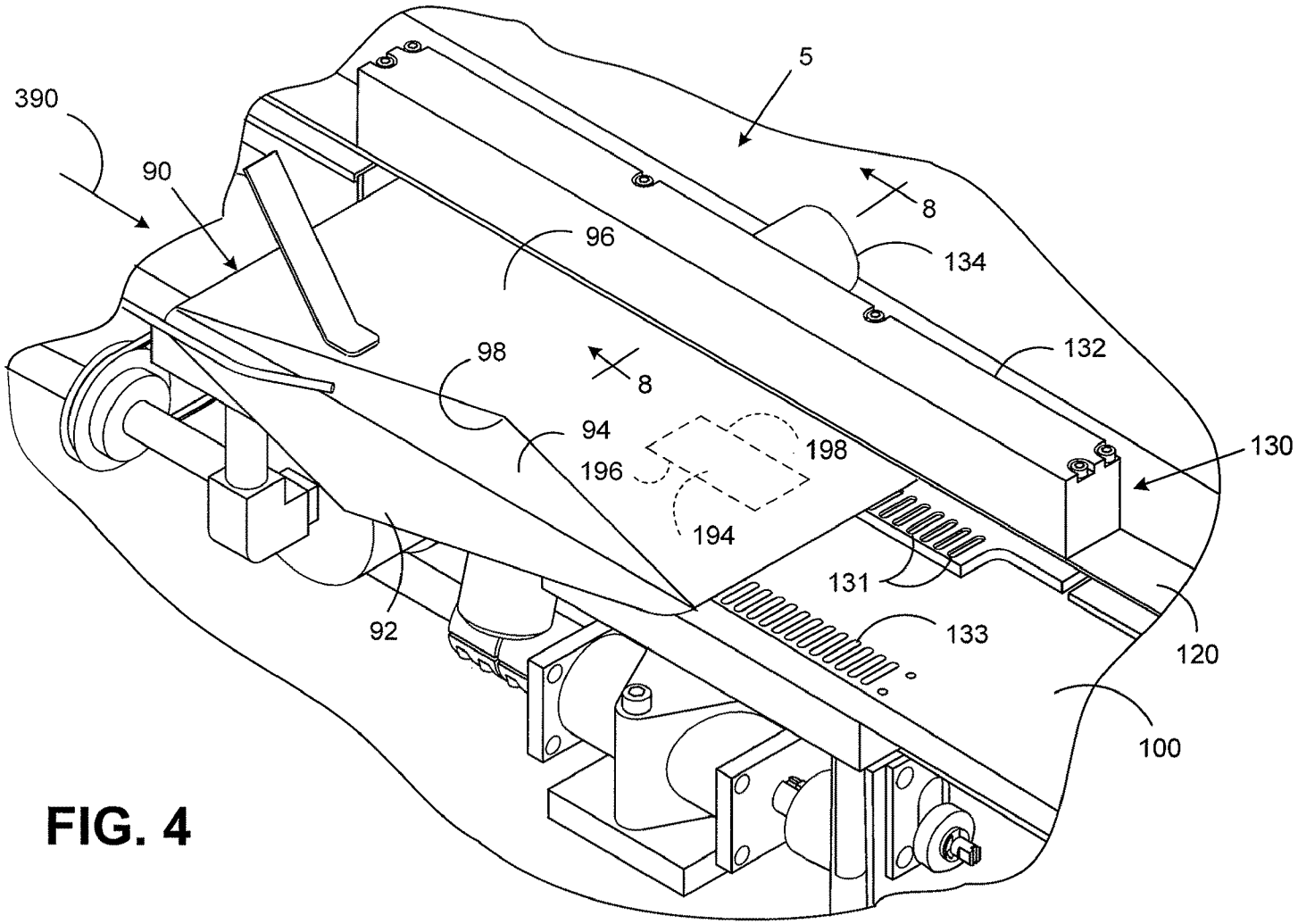
FIG. 4 is a partial perspective view of a mail inserter according to an embodiment of the invention.

FIG. 4 is a perspective view of a part of an inserting station, according to one embodiment of the present invention. As shown in FIG. 4, a securing mechanism is provided in the insertion area for securing the envelope in the insertion location during insertion of a collation. The securing mechanism comprises a first securing element 133 selectively securing a first portion of the envelope between the window and an open edge of the envelope. The securing mechanism further comprises a second securing element, such as the air suction module 130, for example, selectively securing a second portion of the envelope between the window and a closed edge of the envelope.

In the illustrated embodiment, the second securing element comprises a series of slots for providing the vacuum intake. The slots, in one example, are made as a part of the envelope guide 120. The deck 100 comprises conventional drive mechanisms for moving the envelope 90 in and out of the insertion area of the envelope inserting station 5.

It should be noted that the negative air pressure provided by the air suction module when the slots are blocked by the envelope can be very moderate such that the air intake through the slots can be provided even before the envelope has reached the insertion area and when the stuffed envelope is moved out of the insertion area. Alternatively, the air intake can be provided only when the enveloped is located in the insertion area for collation insertion. In that case, the air intake will be turned off when the stuffed envelope is moved out of the insertion area. Thus, a control module can be used to turn the air intake on or off.

Figure 5:
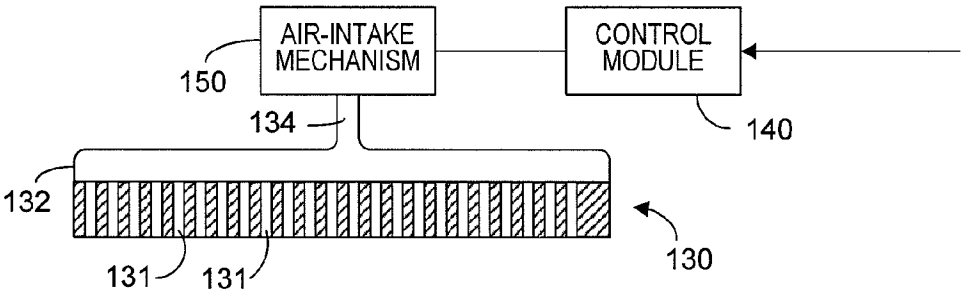
FIG. 5 is a schematic illustrating an arrangement according to an embodiment of the invention for controlling the vacuum suction in a mail inserter.

A schematic representation of the air intake control is shown in FIG. 5. As shown in FIG. 5, the air suction module 130 has a housing 132 and an air conduit 134 connected to the housing. The housing 132 has a housing surface for providing the air intake slots 131. The air conduit is connected to an air intake mechanism 150 that provides the air intake through the slots 131 of the air suction module 130. The air intake mechanism 150 can be turned on or off by a control module 140 upon receiving a collation event signal. For example, the collation event signal can be used to indicate the arrival of the envelope in the inserting station or the collation insertion period so as to allow the air intake mechanism to turn on or off accordingly.

Figure 6:
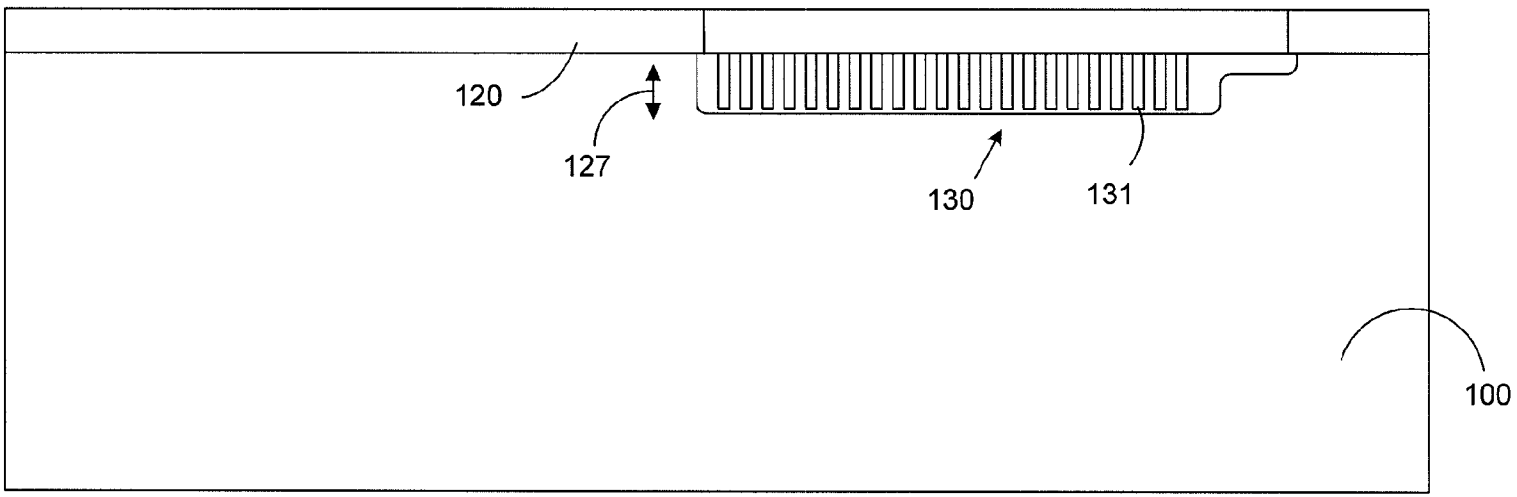
FIG. 6 is a top view of an air suction module integrally formed with an envelope guide, according to an embodiment of the invention.

According to one embodiment of the present invention, the air suction module 130 is fixedly attached to the envelope guide 120, as shown in FIG. 6. In one example, the guide 120 may be integrally formed with the deck 100. Alternatively, the air suction module 130 may be adjustable from the envelope guide, as indicated by the arrow 127. In that arrangement, the guide 120 is movable or adjustable from the deck 100 in order to accommodate envelopes of different sizes. In some cases the envelope windows are located in the same general location of the envelopes.

Figure 7A:
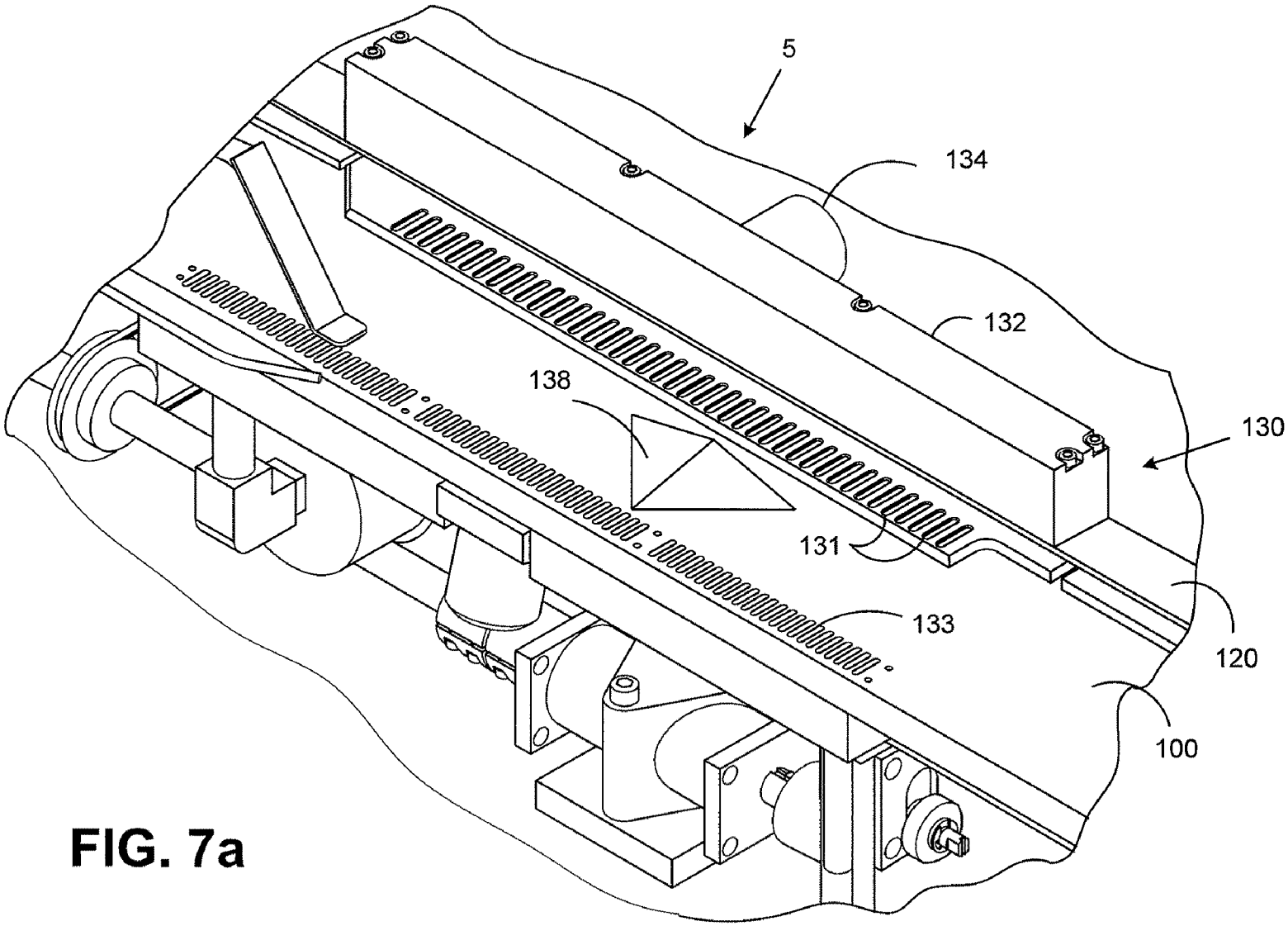
FIG. 7*a* is a partial perspective view of a mail inserter having a deflection element according to an embodiment of the invention.
Figure 7B:
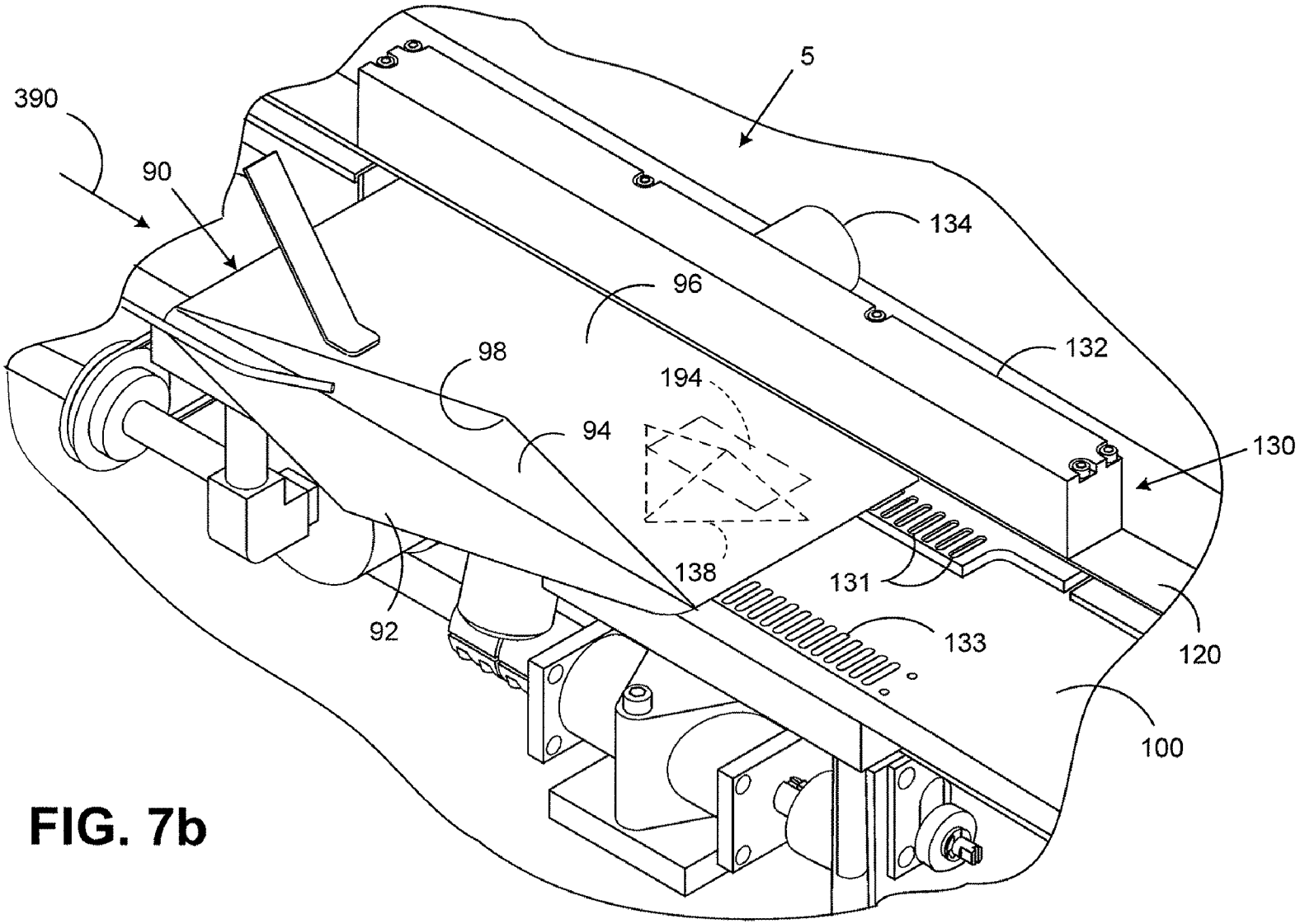
FIG. 7*b* is a partial perspective view of the mail inserter of FIG. 7*a* shown processing an envelope.
Figure 7C:
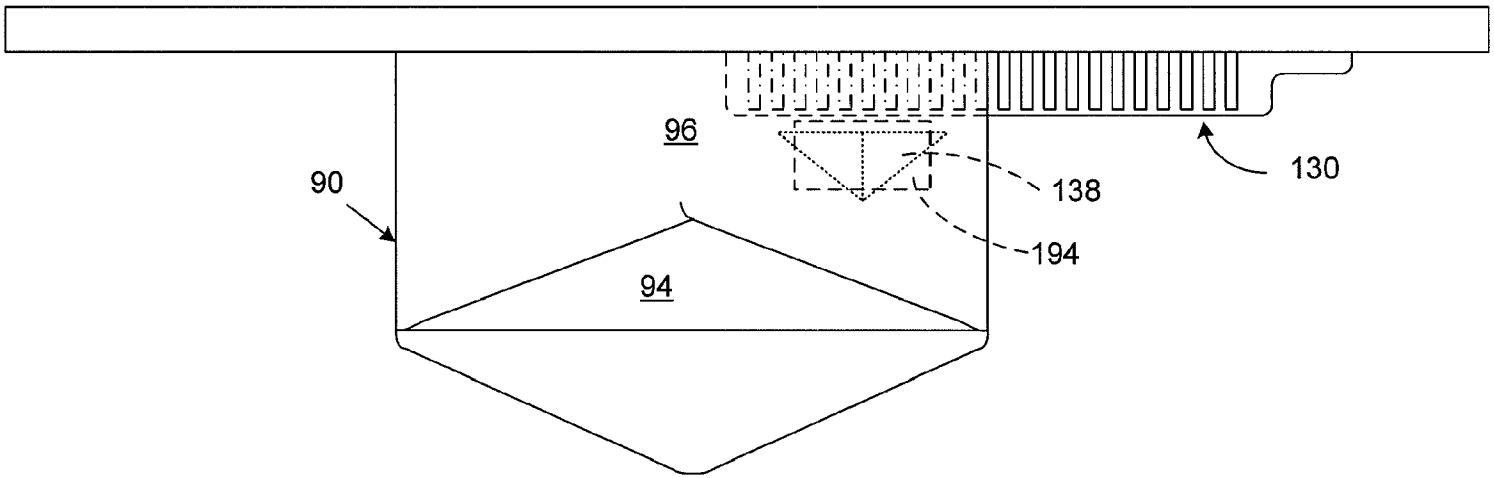
FIG. 7*c* is a top view of an envelope in an insertion area in the inserting station according to an embodiment of the invention.
Figure 7D:
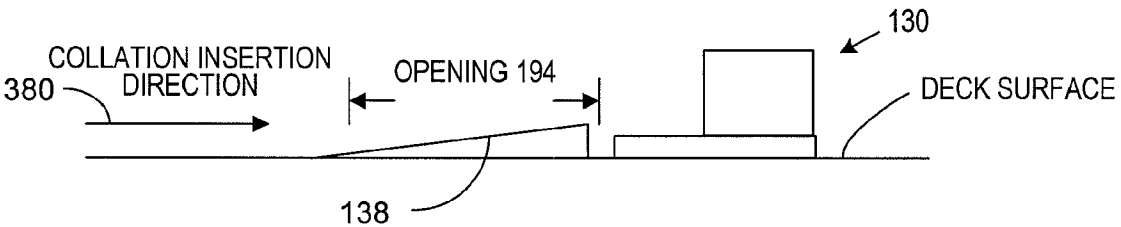
FIG. 7*d* is a side view showing the slope of the deflection element relative to the surface of the deck according to an embodiment of the invention.

According to yet another embodiment of the present invention, a deflection element 138 is placed in the path of collation for guiding the collation to move into the envelope. As shown in FIG. 7*a*, the deflection element 138 is mounted on the deck 100 in the insertion area. The deflection element 138 is located at the window 194 of the envelope 90, as shown in FIGS. 7*b* and 7*c*. The deflection element 138 has a slope, such that at least part of the rear portion of the deflection element 138 rises above the surface of the deck through the window 194 for lifting up the leading edge of a collation 80 when it approaches the window 194 (see FIGS. 7*c*, 7*d*, and 8). Accordingly, part of the leading edge of the collation 80 is always located above the rear edge of the window 194.

Figure 8:
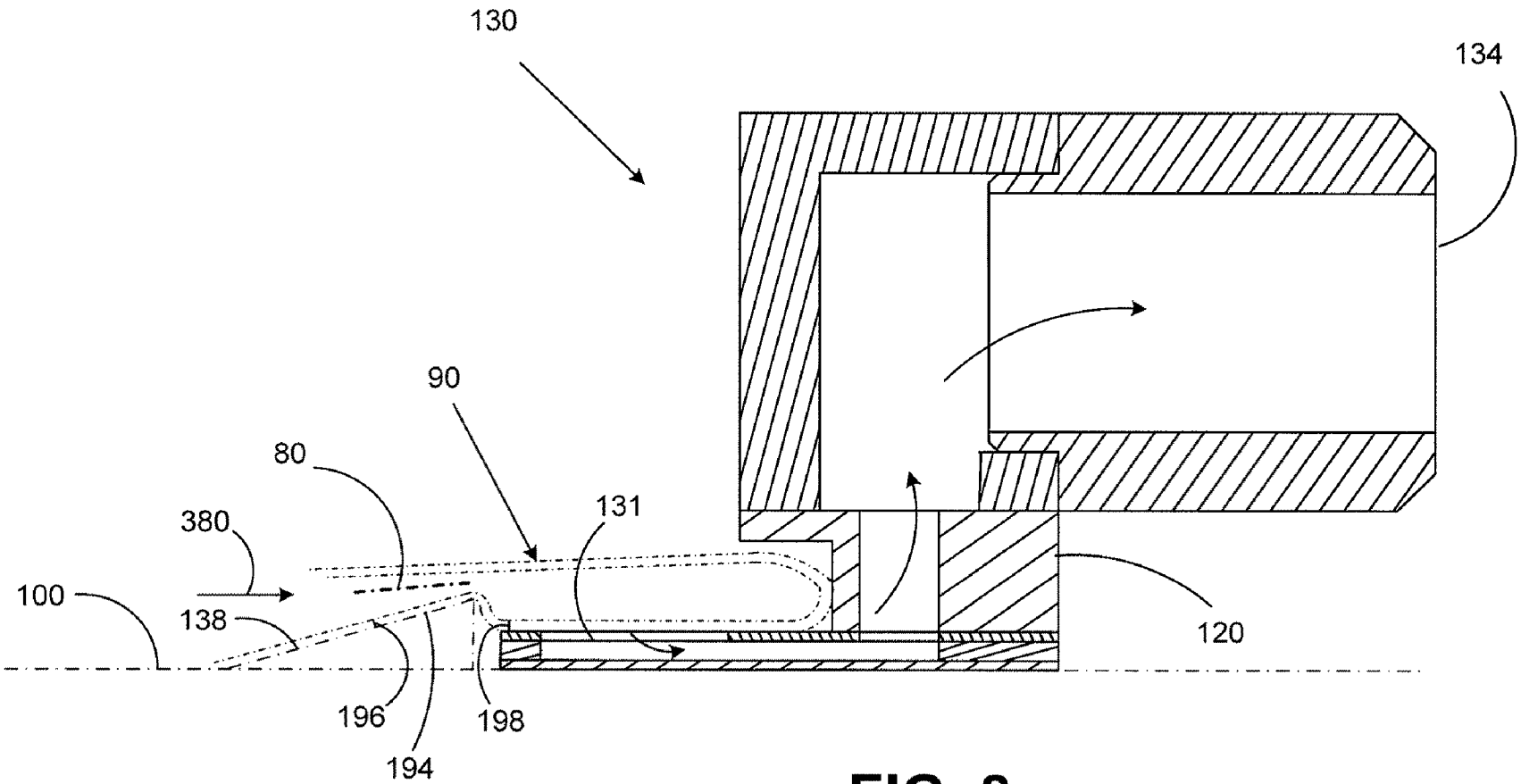
FIG. 8 is a cross-sectional view along line 8-8 of FIG. 4.

FIG. 8 illustrates the arrangement of the deflection element 138 with respect to an envelope 90 in the insertion location. A cross-section of the air suction module 130 is also illustrated.

Embodiments of the present invention provide a method for use in an envelope inserting station. In one example, the method comprises providing an air suction module in an insertion area in the envelope inserting station, wherein the insertion area has a deck for supporting an envelope, and wherein the envelope has a first panel having an open window, a flap connected to the first panel, and a second panel, the first and second panels defining an envelope throat, wherein the first panel is in physical contact with the deck when the envelope is located in the insertion area, with the flap opened to expose the envelope throat to allow insert material to move into the throat. The method may further comprise applying a negative air pressure through the air suction module on at least a section of the first panel adjacent to the open window at least when the insert material is moved into the throat.

According to the embodiments of the invention, the air suction module comprises a plurality of apertures on the deck, such that when the envelope is located in the insertion area, at least some of the apertures are covered by the section of the first panel of the envelope.

According to another embodiment of the invention, the envelope has a first edge, and an opposing second edge where the flap is connected to the first panel, and wherein the envelope inserting station has a guide for guiding the first edge of the envelope when the envelope is moved into the insertion area, and wherein the apertures are located adjacent to the guide.

According to various embodiments of the invention, the guide in the inserting station can be fixedly attached to the deck. Alternatively, the guide can be adjusted so as to accommodate envelopes of different sizes. The air suction module can be integrally formed with guide. Alternatively, the air suction module is fixedly mounted or adjustably mounted on the deck, independently of the guide.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. An inserting system for securing an envelope having a window, the system comprising:

a deck slidably supporting the envelope, the deck defining an insertion area;

a securing mechanism in the insertion area securing the envelope in an insertion location during insertion of a collation, the securing mechanism comprising:

a first securing element selectively securing a first portion of the envelope between the window and an open edge of the envelope; and a second securing element selectively securing a second portion of the envelope between the window and a closed edge of the envelope; and a deflection element disposed on the deck between the first securing element and the second securing element, wherein the deflection element guides the collation away from an edge of the window.

2. The inserting system of claim 1, wherein the first securing element and the second securing element are selectively activated to secure the envelope during the insertion of the collation.

3. The inserting system of claim 1, wherein the first securing element and the second securing element comprise at least one opening in fluid communication with a vacuum source.

4. The inserting system of claim 1, further comprising a guide rail associated with the deck for guiding the closed edge of the envelope, wherein the guide rail is adjustable to accommodate envelopes of various sizes.

5. The inserting system of claim 4, wherein the second securing element is formed integrally with the guide rail.

6. The inserting system of claim 4, wherein the second securing element is separately adjustable from the guide rail.

7. The inserting system of claim 1, wherein the deflection element is removably disposed on the deck.

8. The inserting system of claim 1, wherein the deflection element comprises at least one surface angled away from the deck in a direction of travel of the collation.

9. The insertion system of claim 8, wherein the deflection element comprises a plurality of angled surfaces.

10. The insertion system of claim 1, wherein the deflection element is received in the window of the envelope in the insertion location.

* * * * *